US007448128B2

(12) United States Patent
Kumakura

(10) Patent No.: US 7,448,128 B2
(45) Date of Patent: Nov. 11, 2008

(54) TERMINAL CONNECTING APPARATUS

(75) Inventor: Hideto Kumakura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/447,019

(22) Filed: Jun. 6, 2006

(65) Prior Publication Data

US 2007/0044301 A1 Mar. 1, 2007

(30) Foreign Application Priority Data

Aug. 30, 2005 (JP) ..... 2005-249118

(51) Int. Cl.
*H01R 12/38* (2006.01)
*H01R 43/048* (2006.01)
*H01R 43/058* (2006.01)

(52) U.S. Cl. ..... 29/748; 29/33 M; 29/857; 29/865; 29/753

(58) Field of Classification Search ..... 29/33 M, 29/745, 746, 747, 748, 750, 751, 753, 758, 29/857, 861, 863, 865, 866; 72/420, 428; 227/109

See application file for complete search history.

(56) References Cited

U.S. PATENT DOCUMENTS 3,958,738 A * 5/1976 Tremblay ..... 227/109
4,594,776 A * 6/1986 Anderson ..... 29/749
6,722,034 B2 * 4/2004 Enomoto et al. ..... 29/863

FOREIGN PATENT DOCUMENTS

JP 2002-246091 8/2002
JP 2003-151666 5/2003
JP 2003203703 A * 7/2003

* cited by examiner

*Primary Examiner*—Peter DungBa Vo
*Assistant Examiner*—Livius R Cazan
(74) *Attorney, Agent, or Firm*—Kratz, Quintos & Hanson, LLP

(57) ABSTRACT

Providing a terminal connecting apparatus for improving accuracy of connecting a terminal to a flat circuit body, an applicator main body includes a pair of guide walls for placing and positioning a terminal therebetween so as to arrange front ends of the claws of the terminal opposing toward an FFC and projections projecting respectively from surfaces opposing to each other of the pair of guide walls. When the applicator main body approaches the terminal mounted on the receiving base, the projections slide on outer surfaces of the claws of the terminal and remove parts of plated layers formed on the outer surfaces of the claws. Fresh surfaces of the claws and fresh broken surfaces of the conductor by the claws penetrating therethrough are connected electrically.

2 Claims, 6 Drawing Sheets

TERMINAL CONNECTING APPARATUS

The priority application Number Japan Patent Application 2005-249118 upon which this patent application is based is hereby incorporated by reference.

BACKGROUND OF THE INVENTION

1. Field of the Invention

This invention relates to a terminal connecting apparatus for connecting a terminal to a conductor of a flexible flat circuit body, such as an FPC (Flexible Printed Circuit), an FFC (Flexible Flat Cable).

2. Description of the Related Art

Many various electronic devices are installed in a car as a vehicle. A wiring harness is wired in the car for transmitting electric power and control signals to the electronic devices. The wiring harness includes a plurality of electric wires and a plurality of connectors. The electric wire is a covered wire including a conductive core wire and an insulation cover for covering the core wire.

The connector includes an insulation housing fitting into a mating housing of a mating connector and a conductive terminal to be received in the housing. The terminal has a wire connecting portion to be joined with an end of the electric wire for connecting electrically with the core wire at one end of the terminal, and an electric contact portion to be touched with a mating terminal at another end of the terminal. Connecting the connector housing with the mating connector housing, the wiring harness transmits the control signals to the electronic devices.

In recent years, the wiring harness has increasing number of wires in proportion as the number of electronic devices installed in the car increases. The flat circuit body, such as FFC, FPC, which is lighter and thinner than the round wires used usually and can be wired in high density and in a small space, is applied in many cases.

When the terminal is joined with the flat circuit body, a terminal connecting apparatus 101 shown in FIG. 8 is usually used (refer Patent Document 1). The terminal connecting apparatus 101 includes a receiving base 106 for mounting a flat circuit body 131 on itself, a pair of guide walls 111 arranging and positioning a terminal 134, which has claws 138 bent perpendicularly at both sides of a bottom wall 137 thereof, therebetween, and a pressing member 113 making the claws 138 penetrate through a conductor 132 of the flat circuit body 131 by pressing the terminal 134.

After arranging front ends of the claws 138 of the terminal 134 opposing toward the flat circuit body 131, positioning the terminal 134 to align the pair of guide walls 111 along outer surfaces of the claws 138, pressing the terminal 134 toward the flat circuit body 131 by the pressing member 113, the terminal connecting apparatus 101 makes the claws 138 penetrate into the conductor 132 of the flat circuit body 131. Furthermore, bending each claws 138 penetrating through the conductor 132 and an insulation cover 133 of the flat circuit body 131 inwardly to each other to follow a curved surface of a recess formed at the receiving base 106, the terminal connecting apparatus 101 joins the terminal 134 with the flat circuit body 131.

The terminal 134 is received into the connector housing, so that the flat circuit body 131 joined with the terminal 134 is assembled as the wiring harness.

Patent Document 1 is Japan Patent Published No. 2002-246091.

SUMMARY OF THE INVENTION

Objects to be Solved

According to the above terminal connecting apparatus 101, a width between the pair of guide walls 111 is required larger than a maximum width of the terminal 134 placed between the pair of guide walls 111 to take tolerance into consideration. Thereby, when the width of the terminal 134 is smaller than a nominal value, a large gap between the guide wall 111 and the terminal 134 is generated. If the terminal 134 tilted by the large gap is joined with the flat circuit body 131, the claw 138 may penetrate through a portion other than the conductor 132 and/or may not penetrate perpendicularly through the conductor 132. Thereby, reliability of the connection of the terminal and the conductor would be lower, or defective products may be generated, and product quality is dispersed widely.

To overcome the above problems, an object of this invention is to provide a terminal connecting apparatus, which can improve accuracy of joining a terminal with a flat circuit body and dispersion of product quality.

How to Attain the Object of the Present Invention

In order to attain the objects of the present invention, a terminal connecting apparatus is for connecting a flat circuit body and a terminal, which includes claws bent perpendicularly at both sides of a bottom wall thereof, and includes a receiving base for setting the flat circuit body on a surface thereof; a pair of guide walls for placing and positioning the terminal between the pair of guide walls so as to arrange front ends of the claws of the terminal opposing toward the flat circuit body; a pressing member provided slidably between the pair of guide walls to move and approach the receiving base for making the claws penetrate through a conductor of the flat circuit body by pressing the terminal; an actuator for moving the pair of guide walls close-to/apart-from the receiving base so as to position the terminal between the pair of guide walls by making the pair of guide walls close to the receiving base; and a projection projecting from at least one of surfaces opposing to each other of the pair of guide walls, and the projection slides on an outer surface of the claw to remove a part of the outer surface when the pair of guide walls approaches the receiving base.

The terminal connecting apparatus is further characterized in the terminal connecting apparatus as mentioned above in that an adjusting mechanism capable to change a projecting length of the projection is further included.

EFFECTS OF THE INVENTION

According to the terminal connecting apparatus as mentioned above, front ends of the projections provided at the guide walls are contact points against the terminal. When the width between the pair of guide walls is larger than that of the terminal, making a width between the contact points narrower than that of the terminal by providing the projections, the gap generated between the terminal and guide walls can be absorbed. Thereby, terminal connecting can be acted accurately and dispersion of product quality can be improved.

According to the terminal connecting apparatus as mentioned above, the front ends of the projections provided at the guide walls are contact points against the terminal. Thereby, the width between the pair of guide walls can be designed wider than the width of the terminal, and a width of the pressing member sliding between the pair of guide walls can be designed to increase up to the width between the pair of guide walls. In the terminal connecting apparatus for joining a narrow width terminal, the width of the pressing member can be maximized for maintaining enough strength, so that the pressing member can be prevented from damage.

A part of the claw of the terminal penetrating through the conductor of the flat circuit body is removed by the projection, so that a fresh surface of the claw is generated, and by making contact between the fresh surface and a broken surface of the conductor by the claw penetrating therethrough, conductivity therebetween can be enhanced. Since the part of the claw is removed by the projection, contact area of the terminal and the conductor is increased so that conductivity therebetween can be more enhanced.

According to the terminal connecting apparatus, the projecting length of the projection can be changed by the adjusting mechanism, so that various terminal shaving different dimensions can be applied to the same apparatus.

The above and other objects and features of this invention will become more apparent from the following description taken in conjunction with the accompanying drawings.

DESCRIPTION OF THE PREFERRED EMBODIMENT

A terminal connecting apparatus of an embodiment according to the present invention will be described with reference to FIGS. 1-6. A flat circuit body described in this specification means an electric wiring product formed into a flat-band shape as a whole by covering a flat conductor with an insulation cover, such as an FPC (Flexible Printed Circuit) and an FFC (Flexible Flat Cable).

Figure 1:
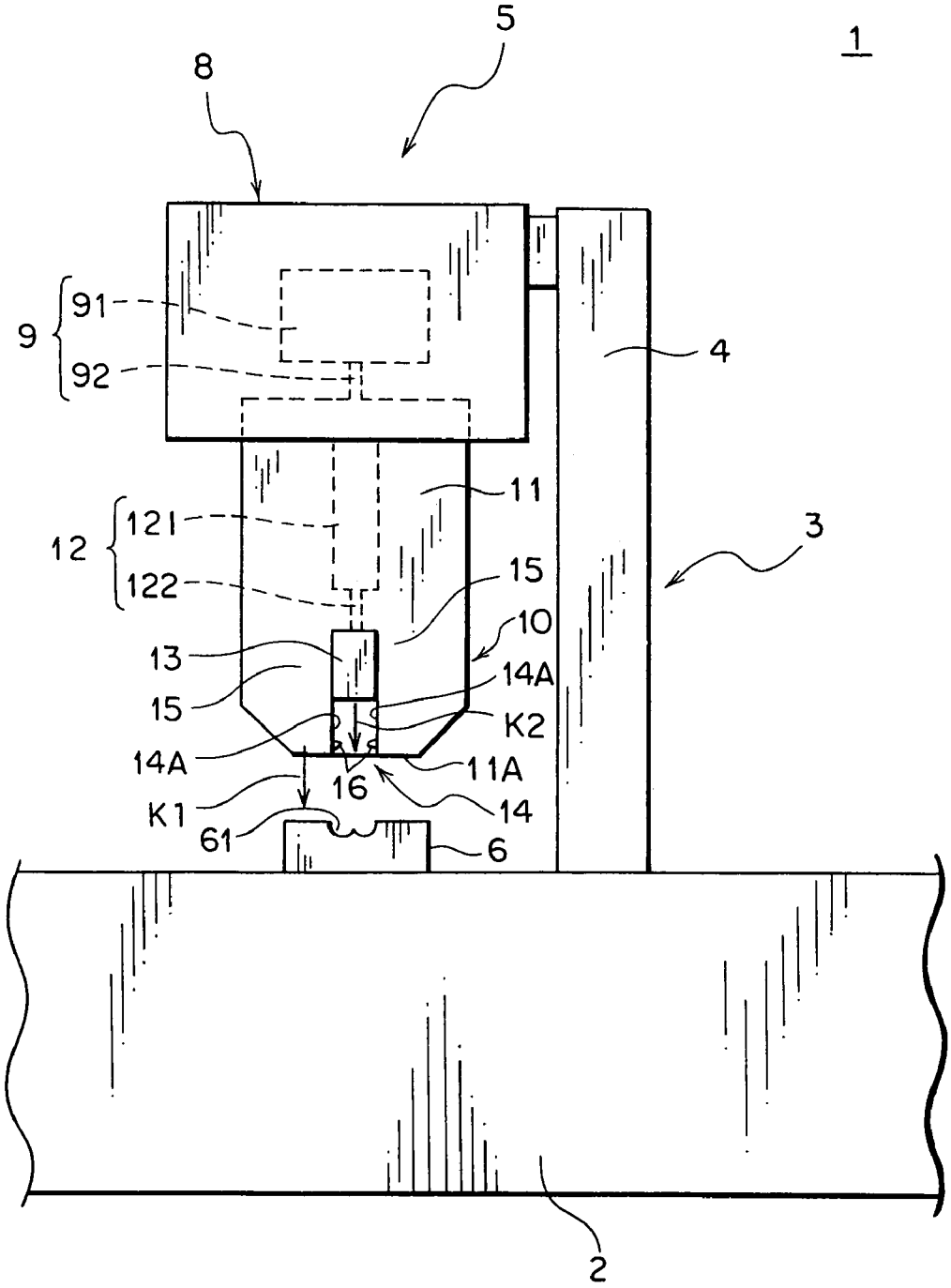
FIG. 1 is a front view of a terminal connecting apparatus of an embodiment according to the present invention.
Figure 2:
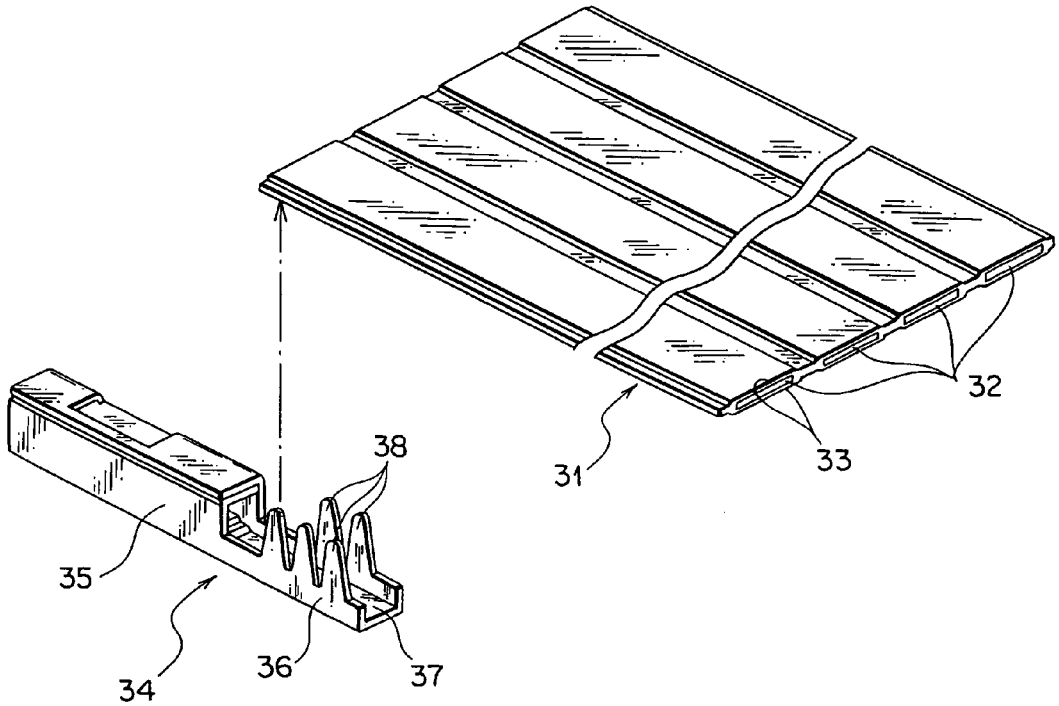
FIG. 2 is a perspective view of an FFC and a terminal to be connected together by the terminal connecting apparatus shown in FIG. 1.

A terminal connecting apparatus 1 shown in FIG. 1 is for joining a terminal 34 shown in FIG. 2 with an FFC 31 as the flat circuit body shown in FIG. 2. The FFC 31 is a flat cable formed by arranging flat conductors 32 in parallel and covering both surfaces of the conductors 32 with an insulation cover 33 such as a polyester tape.

The terminal 34 is made of a sheet metal, which is plated with tin on surfaces of a base metal such as brass. The terminal 34 has an electric contact portion 35 to be connected with a mating terminal and a wire joining portion 36 to be joined with the FFC 31. The wire joining portion 36 has a bottom wall 37 and a plurality of claws 38 extending perpendicularly from both sides of the bottom wall 37. The plurality of claws 38 is arranged along lengthwise of the terminal 34 to oppose alternately to each other at each side of the bottom wall 37. The claws 38 penetrate (break) through the conductor 32 of the FFC 31 and are connected electrically with the conductor 32 by touching the conductor 32. The terminal 34 is fixed on the FFC 31 by bending front ends of the plurality of claws 38 penetrating therethrough inwardly (in directions of opposing) to each other.

The terminal connecting apparatus 1 includes a base 2 installed on a floor of a factory, a crimping unit 3, a wire feeding unit (not shown) and a terminal supplying unit (not shown). The wire feeding unit feeds the FFC 31 cut in a required length to the crimping unit 3. The terminal supplying unit supplies the terminals 34 to the crimping unit 3.

The crimping unit 3 is for connecting the fed FFC 31 and the terminal 34, and includes an arm 4 extending perpendicularly from the base 2, a main body 5 continued to the arm 4 and a receiving base 6 on the base 2 opposing to the main body 5. The receiving base 6 is for setting the FFC 31 on a surface thereof and has a recess 61 formed concavely from the surface. The claws 38 penetrating through the conductor 32 of the FFC 31 go into the recess 61. An inner surface of the recess 61 is curved to bend the front end of the claw 38 going into the recess 61.

The main body 5 includes a mount plate 8 continued to the arm 4, a cylinder 9 mounted on the mount plate 8 and an applicator 10 supported slidably by the cylinder 9. The cylinder 9 has a cylinder main body 91, and a rod 92 connecting the cylinder main body 91 and a later-described applicator main body 11 of the applicator 10. The rod 92 extends from and retracts into the cylinder main body 91 so as to move the applicator main body 11 of the applicator 10 close-to/apart-from the receiving base 6. The cylinder 9 corresponds to an actuator in the present invention.

The applicator 10 includes the applicator main body 11 connected with the rod 92, a cylinder 12 mounted on the applicator main body 11 and a pressing member 13 supported slidably by the cylinder 12.

The applicator main body 11 includes a recess 14 formed concavely from a surface 11A opposing to the receiving base 6, a pair of guide walls 15 having respectively a surface 14A opposing to each other to place the recess 14 therebetween, projections 16 projecting from the surface 14A and an adjusting mechanism 20 capable to change a projecting length from the surface 14A of the projection 16. A plurality of projections 16 is arranged at intervals to each other along lengthwise of the terminal 34 corresponding to each claw 34. A width between the pair of guide walls 15, that is a width between surfaces 14A of the projection 16. A plurality of projections 16 is arranged at intervals to each other along lengthwise of the terminal 34 corresponding to each claw 34. A width between the pair of guide walls 15, that is a width between surfaces 14A, designed wider than a width including tolerance of the terminal 34. A width between the projections 16 at an initial position opposing to each other is designed smaller than the width including the tolerance (minimum width) of the terminal 34. The projections 16 at the initial position means that the projections 16 are in a condition that the projections 16 do not touch to the terminal 34.

Figure 3:
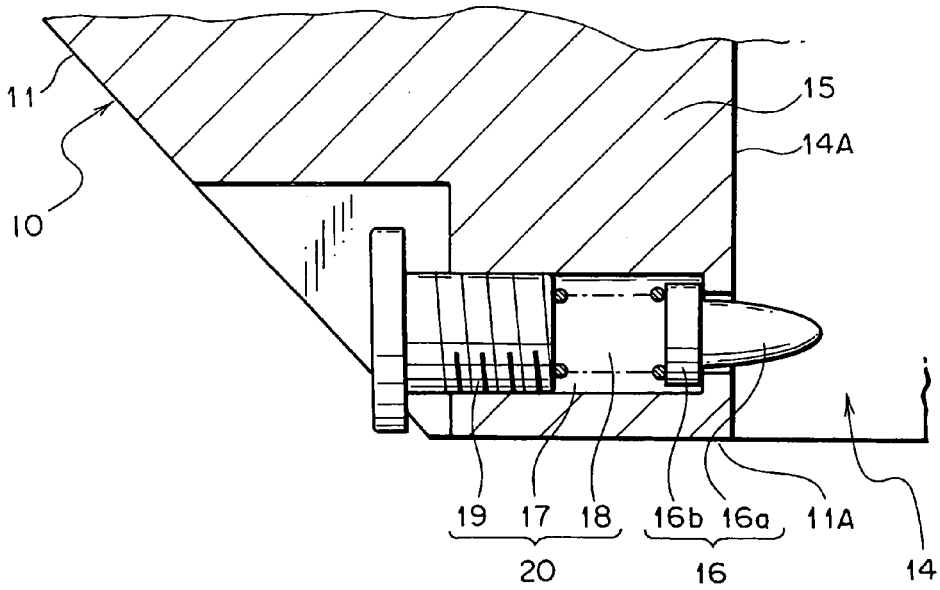
FIG. 3 is a partial expanded view of the terminal connecting apparatus shown in FIG. 1.

Structures of the projection 16 and the adjusting mechanism 20 will be described in detail with reference to FIG. 3. The projection 16 is formed with a cylindrical front end 16*a* and a disk-shaped base end 16*b* continued to the front end 16*a*. An outer diameter of the front end 16*a* is formed smaller than that of the base end 16*b*, and an end of the front end 16*a*, at side apart from the base end 16*b*, is tapered. Such front end

16*a* abuts on the outer surfaces of the claws 38 of the terminal 34 and slides on the outer surfaces. At a side of base end 16*b*, a later-described spring 18 and a bolt 19 are arranged in series.

The adjusting mechanism 20 has a mount hole 17, the spring 18 and the bolt 19. The mount hole 17 is a round cross-sectional hole penetrating horizontally from an outside of the guide wall 15 toward the recess 14. The mount hole 17 is provided at a side near to the surface 14A with a small diameter portion having a smaller diameter than that of the base end 16*b* and a large diameter portion having a larger diameter than that of the base end 16*b* to be continued to the small diameter portion. An end apart from the surface 14A of the large diameter portion is provided with a thread groove engaged with the bolt 19. By screwing the bolt 19 from the outside of the guide wall 15 to the large diameter portion, the projection 16 is assembled in the mount hole 17.

The aforesaid projection 16 is inserted from the large diameter portion into the mount hole 17 so as to expose the front end 16*a* from the surface 14A. The base end 16*b* cannot move over the small diameter portion since the diameter of the base end 16*b* is larger than that of the small diameter portion. The width between the projections 16 opposing to each other to be assembled (width between the projections 16 at each initial position) is narrower than the width of the terminal 34 positioned between the projections 16. When the terminal 34 is positioned between the projections 16 so as to push the projections 16, pushing forces are transmitted respectively through the projections 16 to the springs 18, and the springs 18 are shrunken and projecting lengths of the projections 16 projecting from the surface 14A are shortened.

Spring forces of the springs 18 corresponding to the pushing force are not large enough to deform the terminal 34 over limitation to damage functions of the terminal 34, and are large enough to make the projection 16 shave a part of the outer surface of the claw.

Since the projecting lengths of the projections 16 projecting from the surface 14A are adjusted by the springs 18 as mentioned above, tolerances of the terminals 34 are absorbed and various terminals having different dimensions can be applied. Since the projection 16 can be mounted in and dismounted from the mount hole 17 by screwing the bolt 19, the projection 16 can be replaced with new one when the front end 16*a* is worn out.

The applicator main body 11 approaches the receiving base 6 (in a direction shown with an arrow K1 in FIG. 1) to receive and position the terminal 34, which is arranged so as to make the front ends of the claws 38 oppose toward the FFC 31, in the recess 14, that is between the pair of guide walls 15. When the applicator main body 11 approaches the receiving base 6, the projections 16 slide on the outer surfaces of the claws 38 of the terminal 34 and remove a part of plated layers formed on the outer surfaces of the claws 38. When the rod 92 is most extended, the surface 11A of the applicator main body 11 corresponding to the receiving base 6 abuts on the FFC 31 mounted on the receiving base 6 and presses the FFC 31 toward the receiving base 6.

The cylinder 12 includes a cylinder main body 121 and a rod 122 connecting the cylinder main body 121 and a pressing member 13. The rod 122 extends from and retracts into the cylinder main body 121, so that the pressing member 13 is supported slidably.

The pressing member 13 connected with the aforesaid rod 122 is arranged slidably between the pair of guide walls 15. When the cylinder 12 extends, the pressing member 13 slides toward the receiving base 6 (in a direction shown with an arrow K2 in FIG. 1) so as to press the terminal 34 received between the pair of guide walls 15 toward the FFC 31 and make the claws 38 of the terminal 34 penetrate through the conductor 32 of the FFC 31.

Figure 4:
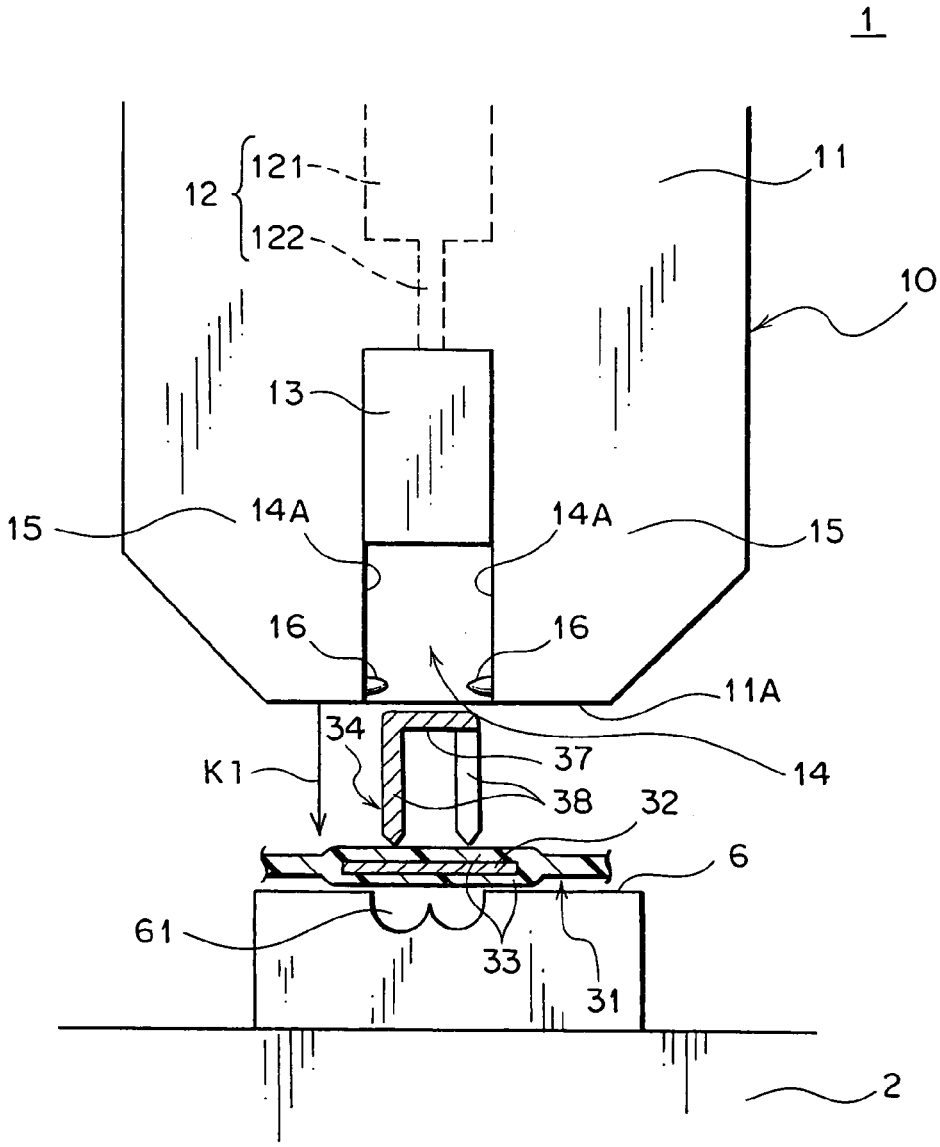
FIG. 4 is a front view of the terminal connecting apparatus shown in FIG. 1, in which the FFC and the terminal are supplied.

For joining the terminal 34 with the FFC 34 by using the above terminal connecting apparatus 1, firstly the cylinders 9, 12 are to be retracted. The FFC 31 transmitted by the wire feeding unit (not shown) is mounted on the receiving base 6 and the terminal 34 supplied from the terminal supplying unit (not shown) is arranged to make the front ends of the claws 38 oppose toward the FFC 31, as shown in FIG. 4.

By extending the cylinder 9, the applicator main body 11 is slid toward the receiving base 6 and moved gradually close to the terminal 34. Firstly, the projections 16 abut on the outer surfaces at base sides of the claws 38. Thereafter, the projections 16, the projecting lengths of which are adjusted to the terminal 34 by the adjusting mechanism 20, slide on the outer surfaces of the claws 38 from the base sides thereof toward the front ends thereof and remove the part of plated layer formed on the outer surfaces of the claws 38. When the applicator main body 11 is positioned to abut on the FFC 31, the terminal 34 arranged between the pair of guide walls 15 is positioned by the pair of guide walls 15.

Figure 5:
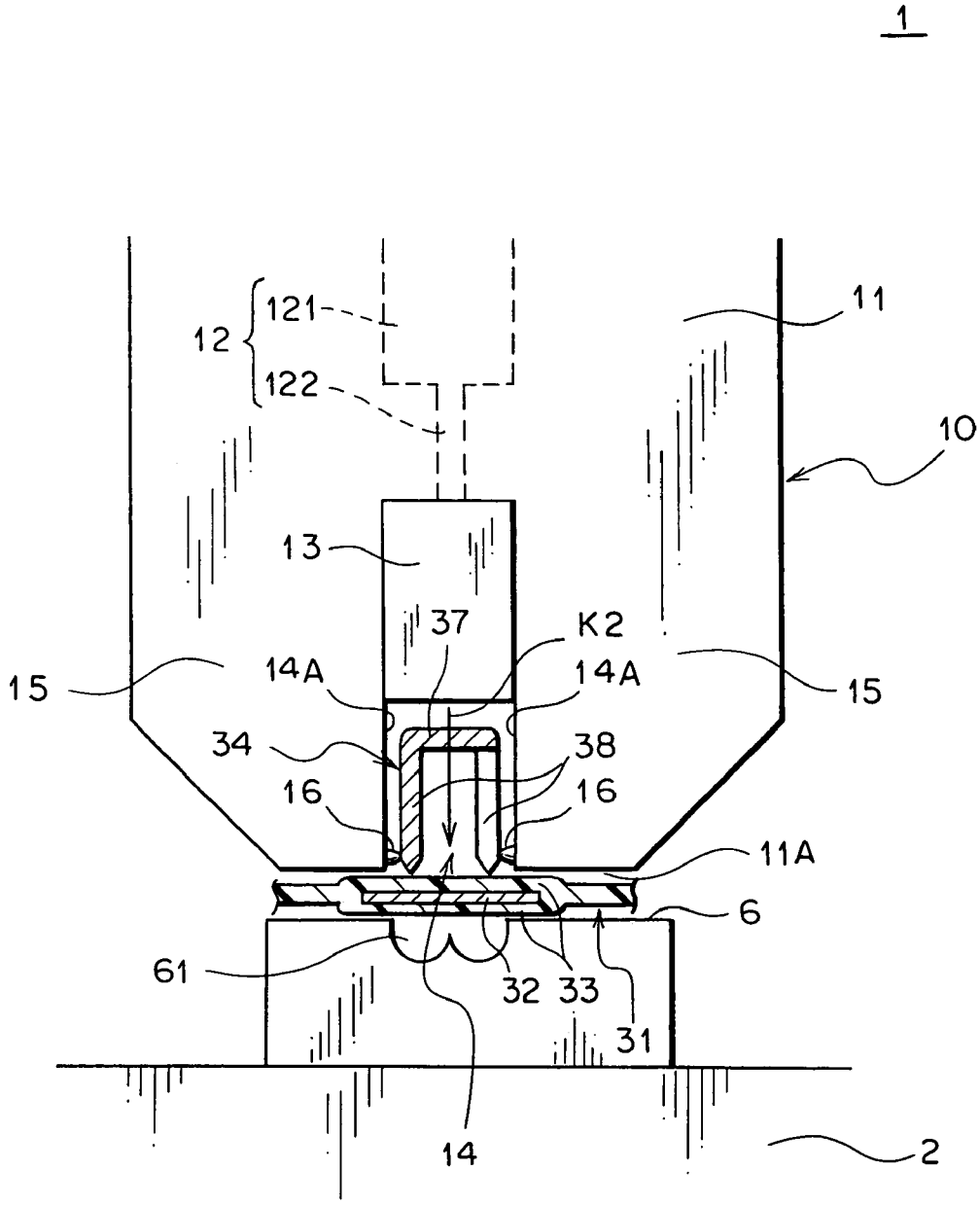
FIG. 5 is a front view of the terminal connecting apparatus shown in FIG. 4, in which the terminal is positioned by a pair of guide walls.
Figure 6:
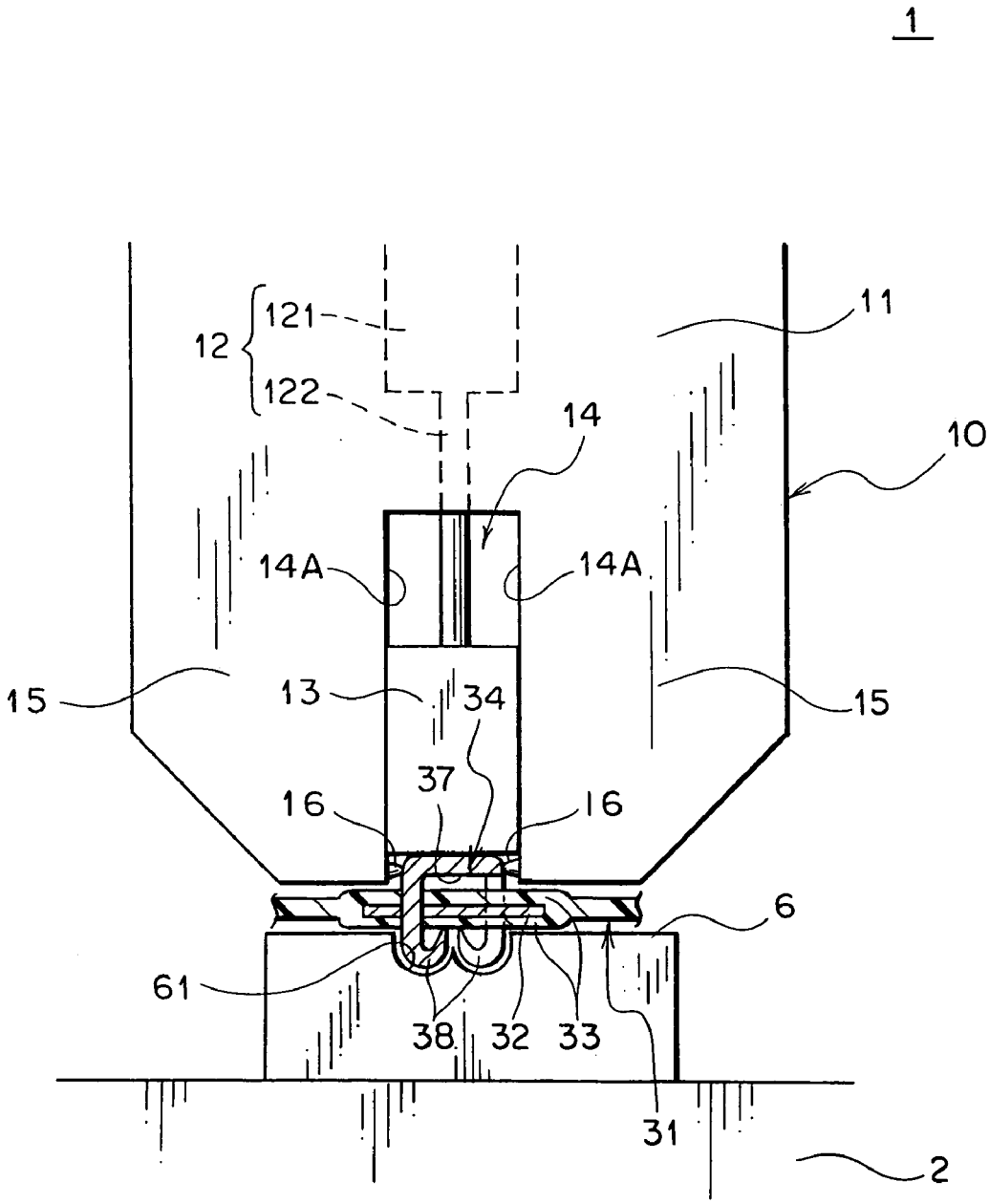
FIG. 6 is a front view of the terminal connecting apparatus shown in FIG. 4, in which the terminal pressed by a pressing member penetrates through the FFC.

By extending the cylinder 12, the pressing member 13 is slid toward the receiving base 6 so as to press the bottom wall 37 of the terminal 34, as shown in FIG. 5. The claws 38, the part of the plated layer formed on the outer surface of which is removed, penetrate through (pierce) the insulation cover 33 and the conductor 32 of the FFC 31 and go into the recess 61 of the receiving base 6. The front ends of the claws 38 going in the recess 61 are bent along the curved inner surface of the recess 61.

Figure 7:
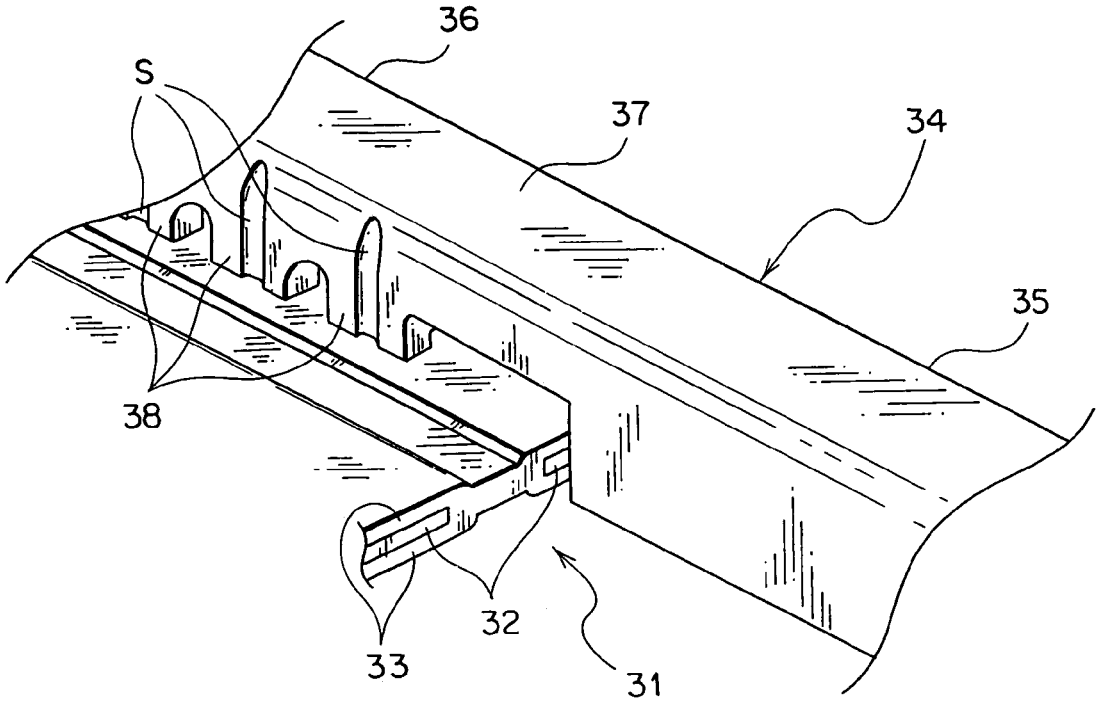
FIG. 7 is a partial perspective view of the terminal connected to the FFC shown in FIG. 6.
Figure 8:
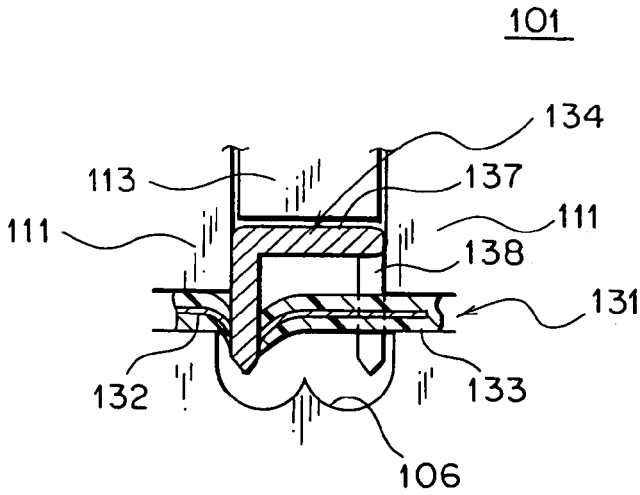
PRIOR ART FIG. 8
FIG. 8 is a partial front view of a terminal connecting apparatus by prior art.

Thus, the claws 38 of the terminal 34 penetrate an end area of the FFC 31, and are bent so as to clamp the FFC 31, so that the FFC 31 and the terminal 34 is connected together electrically and mechanically. The terminal 34 connected to the FFC 31 by the terminal connecting apparatus 1 is shown in FIG. 7. Slide marks S, which are the parts of the plated layers removed by the projections 16, are generated on the outer surfaces of the claws 38 as shown in FIG. 7.

According to the terminal connecting apparatus of the embodiment, since the part of the plated layer of the claws 38 of the terminals 34 penetrating the conductor 32 of the FFC 31 is removed by the projection 16, the claws 38 will have a fresh plated surface. The claws 38 having the fresh plated surface touches a fresh broken surface of the conductor 32 penetrated by the claws 38, so that conductivity therebetween can be improved. Since the part of the claws 38 is removed, contact area between the claws 38 and the conductor 32 is increased, so that conductivity therebetween can be more improved.

In the terminal connecting apparatus 1, by designing the width between the pair of projections 16 provided at the guide walls 15 smaller than that of the terminal 34, a gap between the terminal 34 and the guide walls 15 can be absorbed. Thereby, the terminal 34 can be connected accurately with the FFC 31 and dispersion of product quality can be reduced.

According to the terminal connecting apparatus 1, the front ends of the projections 16 are contact points against the terminal 34, so that the width between the surfaces 14A opposing to each other of the pair of guide walls 15 can be designed wider than the width of the terminal 34. Therefore, the width of the pressing member 13 sliding between the pair of guide walls 15 can be designed up to the width between the surfaces 14A opposing to each other of the pair of guide walls 15. In the terminal connecting apparatus 1 for joining a narrow width terminal 34, the width of the pressing member 13 can be maximized within the width between the surfaces 14A for maintaining enough strength, so that the pressing member 13 can be prevented from damage.

According to the terminal connecting apparatus 1, the projecting length of the projections 16 can be changed by the adjusting mechanism, so that various terminals having different dimensions can be applied to the same apparatus.

In the aforesaid embodiment, the projections 16 are provided respectively at the both of the pair of guide walls 15. According to the present invention, the projections 16 can be provided on at least one of the pair of guide walls 15. The projection 16 in the above embodiment is provided with a separated part retractable from the guide wall 15. According to the present invention, the projections 16 can be formed integrally with the guide wall 15. In other words, the adjusting mechanism 20 is not always required.

In the above embodiment, the adjusting mechanism 20 has a spring 18 mounted together with the projection 16. The adjusting mechanism 20 in the present invention is not always required to have an elastic member such as the spring 18. The projection 16 can be joined at the base end 16*b* directly with the bolt 19, or the projection 16 can be threaded directly.

In the above embodiment, the terminal connecting apparatus 1 includes the receiving base 6 having one recess 61. The terminal connecting apparatus 1 according to the present invention can include the receiving base 6 having two kinds of recesses; one used for making the claws 38 penetrate through the FFC 31, and another used for bending the claws 38 penetrating through the FFC 31. In other words, the terminal connecting apparatus 1 can include any receiving base 6 without limitation of a shape of the recess 61 or number of the recesses 61.

In the above embodiment, the terminal 34 is connected to the FFC 31 as the flat circuit body. In the present invention, the terminal 34 can be connected to the FPC as the flat circuit body.

While the described embodiment represents the preferred form of the present invention, it is to be understood that the present invention is not limited thereto. Therefore, various change and modifications can be made with the scope of the present invention.

What is claimed is:

1. A terminal connecting apparatus for connecting a flat circuit body and a terminal, which terminal includes claws bent perpendicularly at both sides of a bottom wall thereof, comprising:

a receiving base for setting the flat circuit body on a surface thereof;

a pair of guide walls for placing and positioning the terminal between said pair of guide walls so as to arrange front ends of the claws of the terminal opposing toward the flat circuit body;

a pressing member provided slidably between the pair of guide walls to move and approach the receiving base for making the claws penetrate through a conductor of the flat circuit body by pressing the terminal;

an actuator for moving the pair of guide walls close-to/apart-from the receiving base so as to position the terminal between the pair of guide walls by making the pair of guide walls close to the receiving base; and a pair of projections projecting from at least one of surfaces opposing to each other of the pair of guide walls, wherein each projection slides on an outer surface of one of the claws to scratch and thereby remove a part of the outer surface of the claw and form scratch marks, from a base side thereof, adjacent the bottom wall of the terminal, toward an opposite front end thereof, arranged to penetrate the conductor of the flat circuit body, when the pair of guide walls approaches the receiving base.

2. The terminal connecting apparatus according to claim 1, further comprising an adjusting mechanism capable of changing a projecting length of said projections.

* * * * *